US005522661A

United States Patent [19]

Tsukada

[11] Patent Number: 5,522,661

[45] Date of Patent: Jun. 4, 1996

[54] STATIC MIXING MODULE AND MIXING APPARATUS USING THE SAME

[75] Inventor: Ken Tsukada, Tokyo, Japan

[73] Assignee: Tokyo Nisshin Jabara Co., Ltd., Tokyo, Japan

[21] Appl. No.: 365,369

[22] Filed: Dec. 28, 1994

[30] Foreign Application Priority Data

Feb. 16, 1994 [JP] Japan ..... 6-002026 U

[51] Int. Cl.[6] ..... B01F 5/06

[52] U.S. Cl. ..... 366/337; 366/340

[58] Field of Search ..... 366/366, 337, 366/340; 165/109.1; 48/189.4; 138/37, 38, 42

[56] References Cited

U.S. PATENT DOCUMENTS

| | | | |
|---|---|---|---|
| 3,051,453 | 8/1962 | Sluijters | 366/337 |
| 3,923,288 | 12/1975 | King | 138/42 X |
| 4,034,965 | 7/1977 | King | 366/336 |
| 4,061,313 | 12/1977 | Brauner et al. | 336/340 |
| 4,062,524 | 12/1977 | Brauner et al. | 366/340 |
| 4,220,416 | 9/1980 | Brauner et al. | 366/337 |
| 4,296,779 | 10/1981 | Smick | 138/38 |
| 4,336,838 | 6/1982 | Ely | 165/109.1 |
| 4,497,751 | 2/1985 | Pluss | 366/337 X |
| 4,824,614 | 4/1989 | Jones | 366/337 X |

FOREIGN PATENT DOCUMENTS

| | | | |
|---|---|---|---|
| 61-32117 | 7/1986 | Japan . | |
| 1255181 | 9/1986 | U.S.S.R. | 366/337 |

*Primary Examiner*—Charles E. Cooley
*Attorney, Agent, or Firm*—Rogers & Killeen

[57] ABSTRACT

A static mixing module including a pair of mixing parts each having a central strip portion and wing portions. The wing portions are bent in the same direction with respect to the front surface of the central strip portion. The pair of mixing parts are fixed to each other at the back surfaces of the central strip portions, thereby forming grid-shaped spaces each having sides formed by the central strip portion and the wing portions. A cut-out portion is formed between two adjacent wing portions so that complex fluid passages are formed. Mixing apparatuses are also disclosed wherein a plurality of static mixing modules are combined in various ways, or are independently disposed in a pipe with different postures. L-shaped mixing parts are also used in combination with the static mixing module. The mixing apparatuses provide excellent mixing despite of the short length and low pressure loss. Since the mixing apparatus can be easily manufactured and assembled, the production costs can be lowered.

13 Claims, 12 Drawing Sheets

STATIC MIXING MODULE AND MIXING APPARATUS USING THE SAME

BACKGROUND OF THE INVENTION

1. Field of the Invention

The present invention relates to a static mixing module and mixing apparatus, and more particularly to a static mixing module for statically contacting and mixing two or more kinds of fluids (gases, liquids, powders, etc.) in a pipe, and a mixing apparatus including one or more static modules placed in a pipe.

2. Related Art

A static mixing module is usually placed, singly or in combination of two or more modules, in a pipe having a predetermined length and inner diameter to promote the contact and/or mixing of a plurality of kinds of fluids (gases, liquids, powders, etc.) which flow into the pipe. When mixing a gas and a liquid, the static module serves to introduce fine bubbles into the liquid.

U.S. Pat. No. 3,923,288 discloses in its FIG. 2 a low cost module capable of forming a mixing matrix which induces a complex velocity vector in the axial direction of a pipe. Disclosed in FIG. 3 of the above-described U.S. Patent is a mixing module of another type having a mirror-image relationship with the mixing module shown in FIG. 2 of the U.S. Patent. U.S. Pat. No. 4,220,416 also discloses a similar static mixing module in its FIG. 7.

These mixing modules basically have the same configuration as shown in FIG. 19. In these modules, an elliptical plate having wing portions is first formed by blanking, and the wing portions are then alternately bent in the upper and lower directions as viewed in FIG. 19 by two bending operations so as to obtain a configuration in which the wing portions extend in four different directions.

However, the above-described modules require two kinds of dies to carry out the two bending operations, resulting in an increased costs of blanking. Machining costs also increase due to the increased number of bending operations.

The module shown in FIG. 20 is also known as having a high mixing efficiency despite of its relatively short length and low pressure loss. To manufacture this module, pieces (wing portions) having the shapes shown in FIGS. 21A, 22A and 23A are first formed by press working and are then assembled and subjected to welding to obtain the three kinds of blocks shown in FIGS. 21B, 22B and 23B. These blocks are assembled and welded to each other to obtain the structure shown in FIG. 20. The details of this module are disclosed in Japanese Patent Publication (kokoku) No. 61-32117.

In the above-described manufacturing method, the pieces can be obtained by blanking or press working only. This simplifies the die for press working and easily guarantees the accuracy of each part. However, the kinds and number of parts must be increased considerably to conform with variations in the dimensions of a pipe in which the module is to be disposed. This increases the difficulty in selecting parts and managing supplementation of parts, leading to problems in quality control, such as mixing of foreign parts. Further, the manufacturing method is disadvantageous from the viewpoint of the production costs and the production efficiency. The necessity of a special welding machine for welding many welding points also increases the production costs.

SUMMARY OF THE INVENTION

An object of the present invention is to provide an improved static mixing module and mixing apparatus which can provide excellent mixing despite of its short length and low pressure loss, which facilitate their forming and assembly operations, and which can be manufactured at low costs.

To achieve the above-described object, the present invention provides a static mixing module including a pair of static mixing parts of a first kind (hereinafter referred to as "first mixing parts"). Each of the first mixing parts has a central strip portion, wing portions each having a predetermined width, and cut-out portions. The wing portions perpendicularly extend from a pair of bending lines each formed between the central strip portion and the wing portions. On one side of the central strip portion, the wing portion(s) and the cut-out portion(s) are alternately formed. On the other side of the central strip portion, the wing portion(s) and the cut-out portion(s) are alternately formed in a staggered relationship with the wing portion(s) and the cut-out portion(s) formed on the one side of the central strip portion. All the wing portions are bent in the same direction by a predetermined angle with respect to a front surface of the center strip portion. The pair of first mixing parts are assembled and fixed to each other at their back surfaces.

A mixing apparatus which can achieve the above object includes a plurality of static mixing modules each having the above-described structure. These mixing modules are combined with each other in various ways, or independently disposed in a pipe with different postures. The above-described static mixing module can be used in combination with another mixing part(s) of a second type (hereinafter referred to as "second mixing parts"). In this case, the static mixing module(s) and the second mixing part(s) are combined with each other in various ways, or independently disposed in a pipe with different postures.

DESCRIPTION OF THE PREFERRED EMBODIMENTS

Embodiments of static mixing modules and mixing apparatuses according to the present invention will be described with reference to the accompanying drawings.

Figure 1:
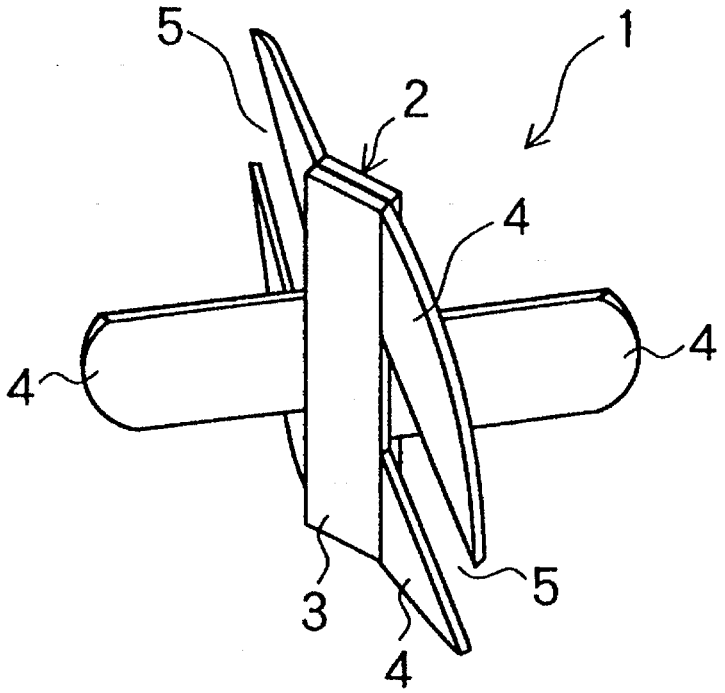
FIG. 1 is a perspective view showing an embodiment of the static mixing module according to the present invention.
Figure 2:
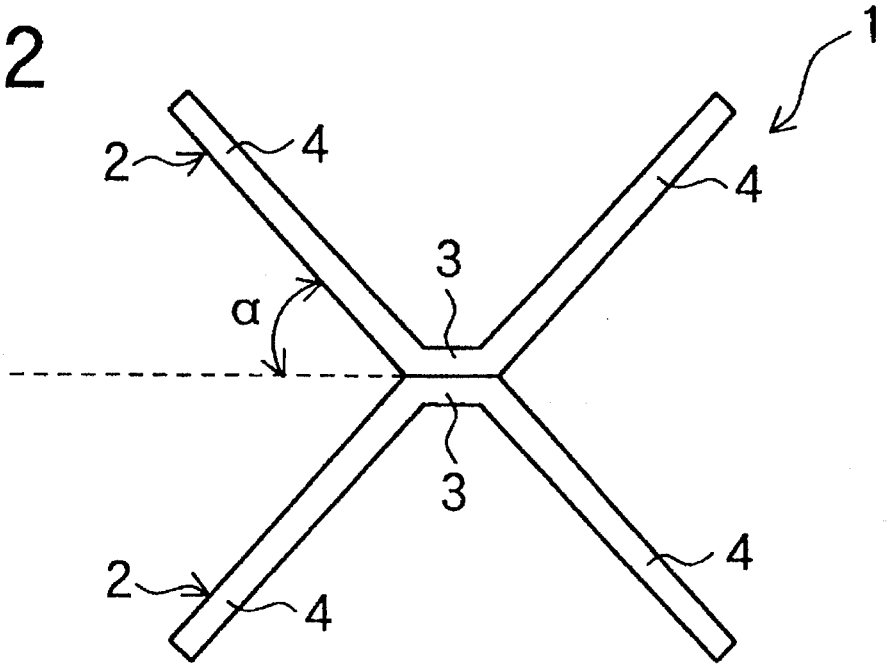
FIG. 2 is a plan view of the static mixing module shown in FIG. 1.

First Embodiment:

FIG. 1 is a perspective view showing an example of the static mixing module according to the present invention, and FIG. 2 is a plan view of the static mixing module.

No limitations are imposed on the method of manufacturing the static mixing module 1. For example, an elliptical plate is cut out from a plate material by wire cutting, blanking, or the like. The elliptical plate is then subjected to a bending operation to obtain a first mixing part 2 having a central strip portion 3, wing portions 4, and cut-out portions 5.

The bending angle a of the wing portions 4 obtained by the bending operation is preferably in the range of 5°–85°, and more preferably 10°–75°, with respect to the front surface of the central strip portion 3. Each pair of first mixing parts 2 are assembled and fixed to each other at the back surfaces (hereinafter also referred to as "joint surfaces") of the central strip portions 3 such that the wing portions 4 of one of the first mixing parts 2 correspond to the cut-out portions 5 of the other of the first mixing parts 2, thereby forming the static mixing module 1.

The method of manufacturing the mixing module 1 is not limited to the above-described method, and the mixing module 1 may be manufactured by extrusion molding, injection molding, or the like.

The module may be made of any material such as steel or resin, but the material is not limited thereto.

The module is placed in a pipe for use. The module may be disposed in a posture such that the back surface or joint surface of each central strip portion becomes parallel to the flow direction of fluids entering into the pipe, or becomes perpendicular to the flow direction.

Various kinds of modules can be manufactured by changing the number and length of the wing sections 4 of each of the first mixing parts 2.

The size of the first mixing parts 2 can be changed in accordance with a pipe for which the first mixing parts 2 are used. The module according to the present embodiment can be used for a pipe having a diameter ranging from 10 mm to 3000 mm. Accordingly, the module according to the present embodiment can be applied to reactors and the like. The present invention encompasses such reacters and the like.

Since the module of the present embodiment can be manufactured by a reduced number of manufacturing steps, the production costs can be lowered. Also, since the module is manufactured by fixing a pair of first mixing parts to each other, the higher strength can be obtained compared to conventional modules formed by bending a single plate.

Figure 3:
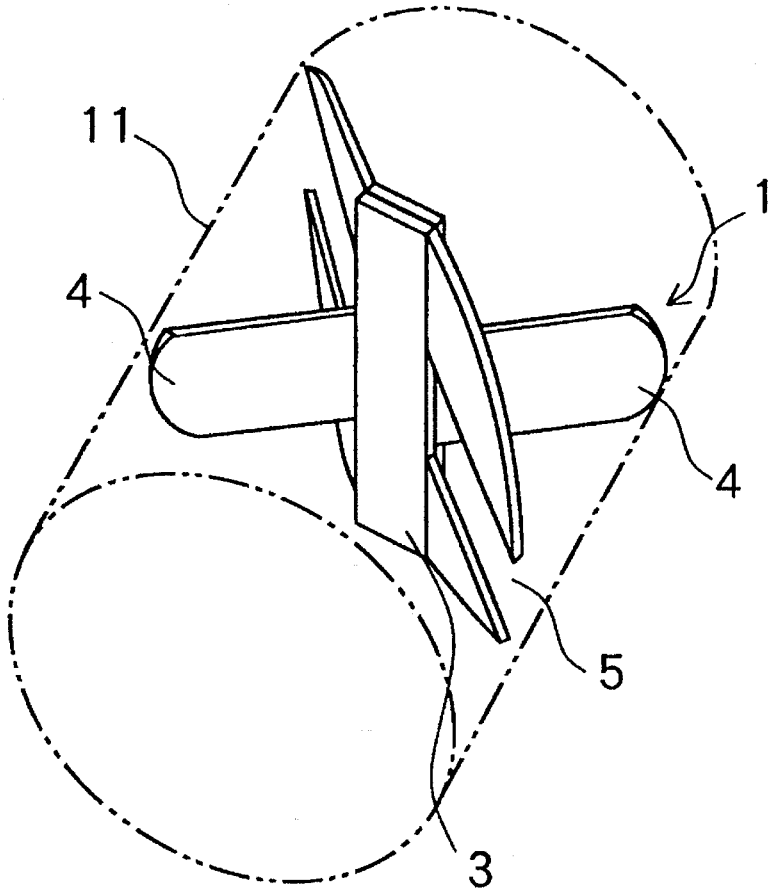
FIG. 3 is a perspective view showing an embodiment of the mixing apparatus according to the present invention.
Figure 4:
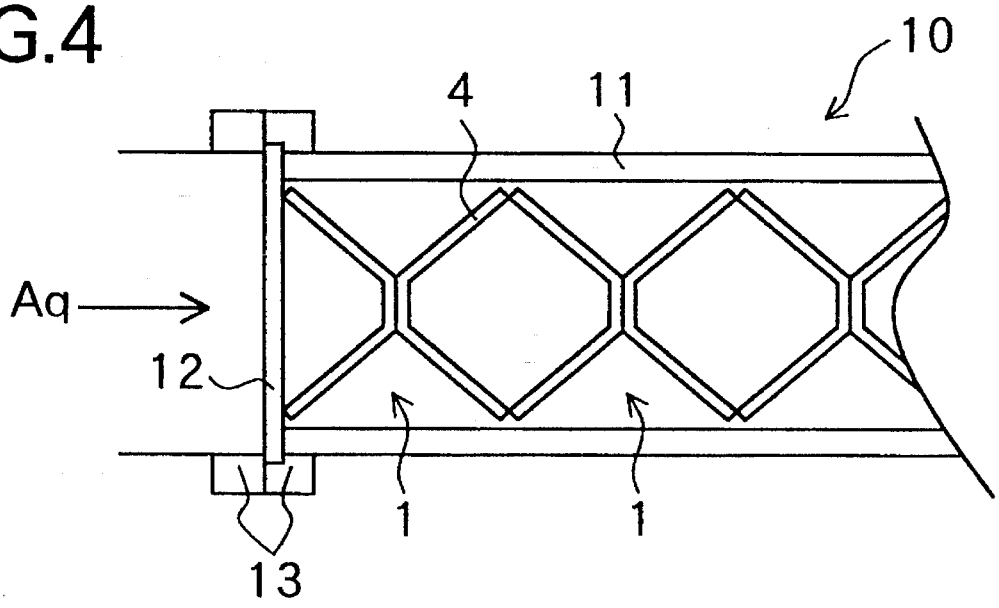
FIG. 4 is a side sectional view of the mixing apparatus shown in FIG. 3.

Second Embodiment:

FIG. 3 is a perspective view showing an embodiment of the mixing apparatus according to the present invention, and FIG. 4 is a side sectional view of the mixing apparatus shown in FIG. 3.

In a mixing apparatus 10 shown in FIGS. 3 and 4, the module 1 according to the first embodiment is placed in a pipe 11 such that the joint surfaces of the central strip portions become perpendicular to the flow direction of fluids which flow into the pipe 11. It is preferred that the diameter of the pipe 11 for enclosing a plurality of modules 1 be slightly larger than the longitudinal dimension of the central strip portions 3 of each module 1. No limitations are imposed on the material of the pipe 11. Fluid flowing through the pipe may be a gas, a liquid, a powder or the like, or a mixture of two or more kinds of fluids. Combinations of the fluids include liquid and gas, liquid and liquid, liquid and powder, and power and powder. Also, a fluid having a high viscosity and a fluid having a low viscosity may be mixed with each other.

In FIG. 4, numeral 12 denotes a fixing member for fixing the module 1 to the pipe 11. Although the fixing member may have any shape, it is particularly preferred that a fixing ring having an outer diameter slightly larger than the inner diameter of the pipe be used as the fixing member 12.

As shown in FIG. 4, the tips of the wing sections 4 of the module 1 are joined to the fixing member 12 by welding or the like. The fixing member 12 is held by fixing means 13 composed of a pair of flanges so that the module 1 is fixed to the pipe 11. The fixing means 13 may be other types of fixing mechanisms other than the fixing mechanism using flanges.

In the case where a plurality of modules 1 are placed in the pipe 11, it is preferred that adjacent modules 1 be joined to each other at several points by welding or the like.

After the plurality of modules 1 which have been integrally joined are inserted into the pipe 11, the fixing member 12 is fixed to the pipe 11 via the fixing means 13. With this structure, the modules 1 are prevented from being rotated due to the pressure of fluid, thereby maintaining its high mixing efficiency.

When a plurality of kinds of fluids Aq supplied from the direction shown by the arrow flow into the pipe 11 through the opening of the fixing means 13, the fluids form a mixing matrix due to the existence of the central strip portions 3, the wing portions 4 and the cut-out portions 5, thereby inducing a complex velocity vector in the axial direction of the pipe 11. As a result, the fluids are mixed and agitated.

The size, number, length, etc., of the modules 1 may be varied to form various mixing apparatuses having different mixing capability.

In the mixing apparatus according to the present embodiment, a mixing matrix for inducing a complex velocity vector can be formed by the combination of the central strip portions 3, the wing portions 4, and the cut-out portions 5. Accordingly, a high agitation effect can be obtained, especially in the agitation of a fluid having a relatively small viscosity. In addition, since the periphery of the modules 1 are separated from the inner surface of the pipe 11, pressure loss due to contact between the modules 1 and the pipe 11 is not produced.

Since all the modules 1 can be manufactured using parts having the same configuration, the production costs can be reduced.

Figure 5:
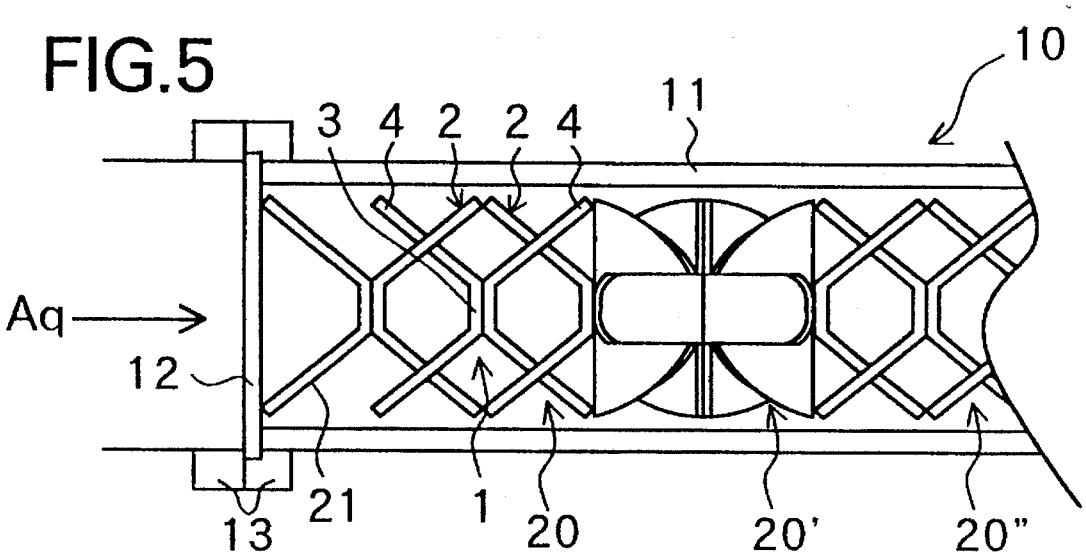
FIG. 5 is a side sectional view showing another embodiment of the mixing apparatus.

Third Embodiment:

FIG. 5 is a side sectional view showing another embodiment of the mixing apparatus.

As shown in FIG. 5, the module 1 according to the first embodiment is placed in a pipe 11 such that the joint surfaces of the central strip portions become perpendicular to the flow direction of fluids which flow into the pipe 11. A pair of first mixing parts 2 are placed on both sides of the mixing module 1 such that wing portions 4 of the module 1, which are located at both ends of the module 1, extend in a direction opposite to the direction in which wing portions 4 of the first mixing parts 2 on both sides of the mixing module 1 extend, and that the longitudinal direction of the central strip portions 3 of the module 1 coincides with the longitudinal direction of the central trip portions 3 of the first mixing parts 2. Further, the wing portions of the first mixing parts 2 are inserted into corresponding cut-out portions of the module 1 and the wing portions of the module 1 are inserted into corresponding cut-out portions of the first mixing parts 2 to complete a mixing module 20. In other words, the mixing module 20 is composed of the module 1 according to the first embodiment, and two first mixing parts 2.

A plurality of modules 20 are manufactured and are placed in a pipe 11 to obtain a mixing apparatus 10. In the present embodiment, two adjacent modules, i.e., the first module 20 and the second module 20' are joined to each other after the second module 20' has been rotated by 90° with respect to the first module 20 while making the joint surfaces of the central strip portions 3 of both the first and second modules 20 and 20' perpendicular to the flow direction of fluids flowing into the pipe 11. The angle of the rotation may be arbitrarily varied in the range of 45°–90°.

Moreover, the third module 20" is joined to the second module 20' after the third module 20" has been rotated by 90° with respect to the second module 20'. In this manner, a plurality of modules are successively joined with successive rotations of 90°, and then inserted into the pipe 11 to complete a mixing apparatus.

Although any means can be used to fix the modules 20, 20', 20", etc., to the pipe 11, the first module 20 adjacent to the fixing member 12 is fixed to the pipe 11 through the fixing member 12. In the present embodiment, an additional mixing part 21 is interposed between the fixing member 12 and the module 1 for fixing the module 1 to the fixing member 12.

The present embodiment may be modified to use two or more modules 1 to form each of the modules 20, 20', 20", etc. In this case, a pair of mixing parts 2 similar to those shown in FIG. 5 are arranged on both sides of a set of two or more modules 1 to complete each of the modules 20, 20', 20" etc.

In the mixing apparatus according to the present embodiment, a larger amount of turbulent flow occurs compared to the mixing apparatus according to the second embodiment if it has the same length as the mixing apparatus according to the second embodiment has. Further, a mixing matrix, wherein a complex velocity vector in the axial direction is induced due to the existence of the central strip sections 3, the wing sections 4, and the cut-out sections 5, becomes more complex. Accordingly, a greater effect can be obtained when agitating a fluid having a small viscosity.

Since all the modules 1 can be manufactured using parts having the same configuration, the production costs can be reduced.

Figure 6:
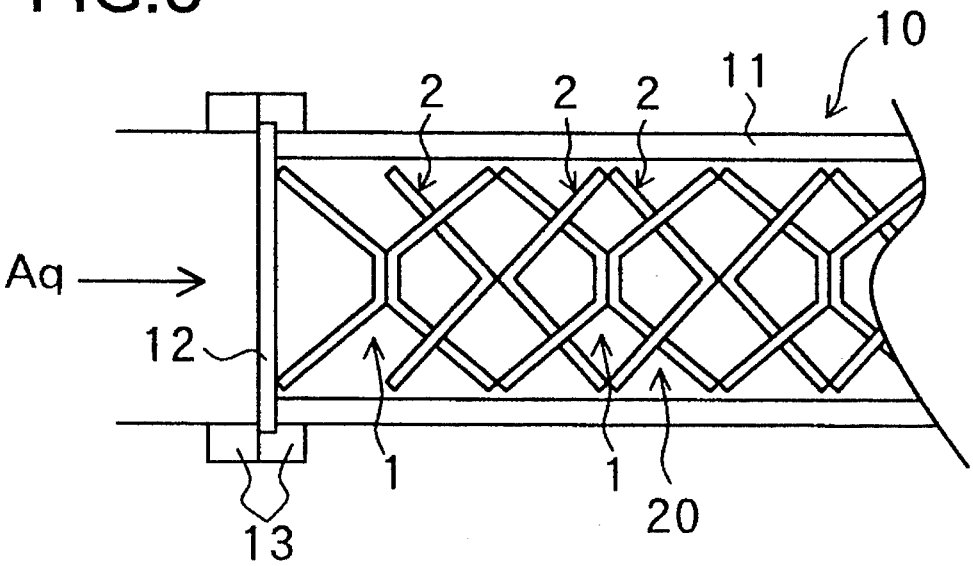
FIG. 6 is a side sectional view showing still another embodiment of the mixing apparatus.

Fourth Embodiment:

FIG. 6 is a side sectional view showing still another embodiment of the mixing apparatus.

As shown in FIG. 6, the module 1 according to the first embodiment is placed in a pipe 11 such that the joint surfaces of the central strip portions become perpendicular to the flow direction of fluids which flow into the pipe 11, like the third embodiment. However, the central strip portion of a mixing part, which is disposed on the left side and/or right side of the module 1, as viewed in FIG. 6, has a different shape compared to the mixing part used in the third embodiment.

Figure 7:
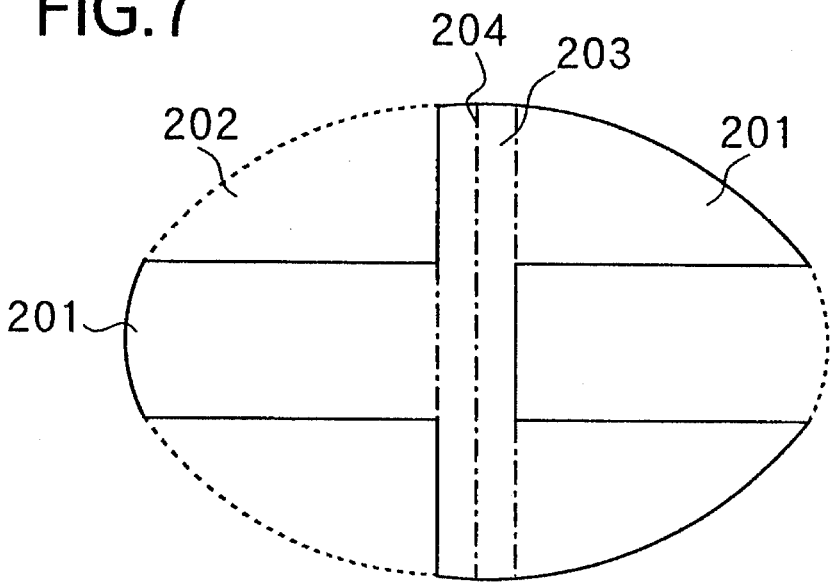
FIG. 7 is a plan view showing an example of the manufacturing method for manufacturing a second mixing part.

As shown in FIG. 6, each of mixing parts 2 used in the present embodiment has an L-like shape, and are referred to as "second mixing parts" in this specification. First, an elliptical plate having a central strip portion 203, wing portions 201, and cut-out portions 202 is cut out from a plate material by blanking or wire cutting, as shown in FIG. 7. The elliptical plate is then bent at the center line 204 extending along the short axis to obtain a second static mixing part 2. The bending angle of the wing portions 201 obtained by the bending operation is preferably in the range of 5°–85°, and more preferably 10°–75°.

The length and number of the wing portions 201 may be arbitrarily varied.

Figure 8:
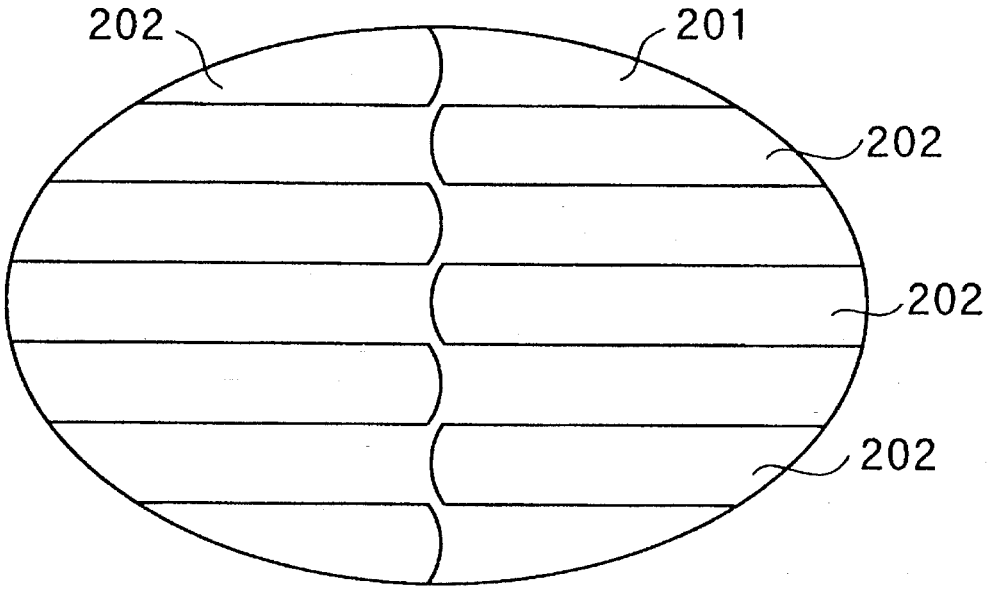
FIGS. 8 and 9 are plan views showing another example of the manufacturing method for manufacturing the second mixing part.
Figure 9:
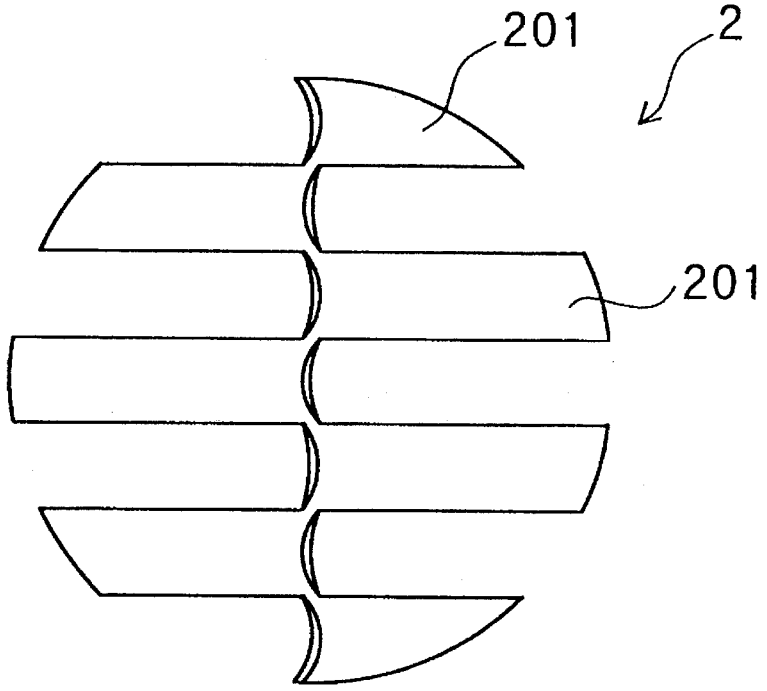

FIGS. 8 and 9 show another example of the second mixing part. In detail, an elliptical plate is subjected to wire cutting to form wing portions 201 and cut-out portions 202. The cut-out portions 202 reach the center line extending along the short axis. The cut-out portions each have an arcuate shape at the center line so an apex of the arcuate shape extends beyond the center line. Accordingly, the width of the central strip portion becomes almost zero, and the central strip portion may be imaged as a line. Subsequently, the elliptical plate is bent at the center line extending along the short axis with a bending angle similar to the above-described case to obtain the second mixing part 2 shown in FIG. 9. The second mixing part 2 thus formed has a substantially circular outer shape, as viewed in the direction of the bisector of an angle formed between the wing portions formed on both sides of the central strip portion which may be imaged as a line. This shape makes it possible to install the second mixing part 2 in a pipe having a circular cross section.

The number and length of the wing sections of the second mixing part can be varied, like the first mixing part with a central strip portion having a predetermined width.

The module 20 according to the present embodiment shown in FIG. 6 is composed of the module 1 of the first embodiment and a pair of second mixing parts 2.

A plurality of such mixing modules 20 are manufactured and are inserted into a pipe 11 to form a mixing apparatus 10.

The mixing apparatus according to the present embodiment produces less pressure loss compared to the mixing apparatuses according to the second and third embodiments if it has the same length as those mixing apparatus have. Accordingly, a high mixing effect can be obtained when agitating a fluid having a medium viscosity, like the mixing apparatuses according to the second and third embodiments.

Figure 10:
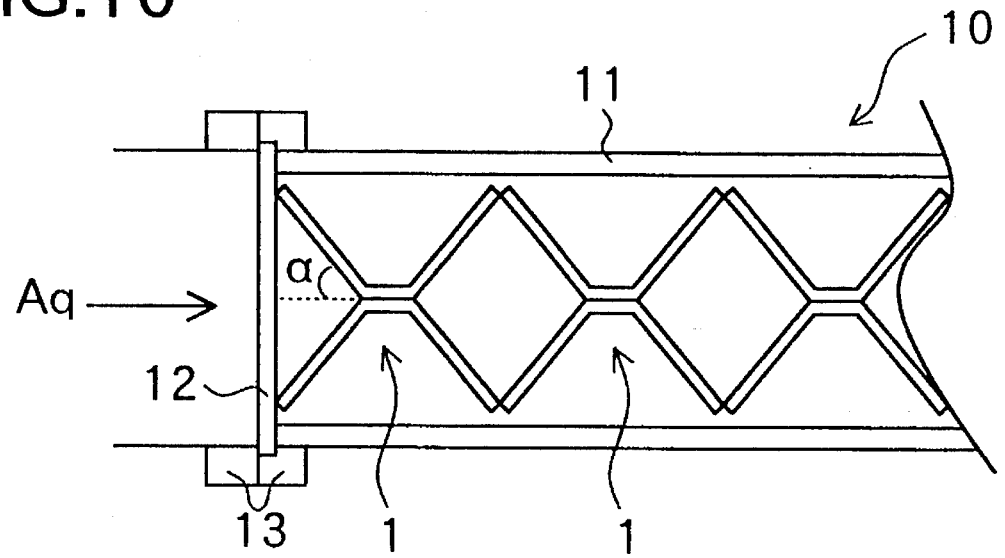
FIG. 10 through FIG. 15 are side sectional views showing other embodiments of the mixing apparatus.

Fifth Embodiment:

FIG. 10 is a side sectional view showing another embodiment of the mixing apparatus according to the present invention.

In the present embodiment, the module 1 shown in FIG. 2 is placed in a pipe 11 such that the joint surfaces of the central strip portions become parallel to the flow direction of fluids which flow into the pipe 11. The module 1 is fixed to the pipe 11 in the manner described in the aforementioned embodiments.

The bending angle $\alpha$ of the module 1 is preferably in the range of 5°–85°, and more preferably 10°–75°.

The mixing apparatus 10 according to the present embodiment can provide a high agitation effect with less pressure loss compared to the mixing apparatus shown in FIG. 4.

Figure 11:
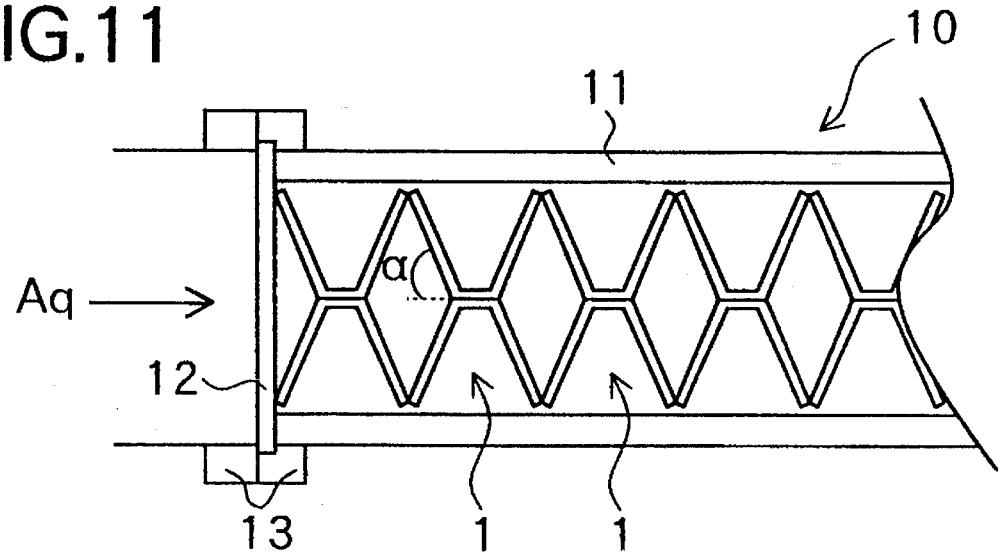

FIG. 11 shows another embodiment of the module 1 wherein the bending angle $\alpha$ is set to be larger than the bending angle $\alpha$ of the module shown in FIG. 10. This mixing apparatus is suitable for mixing fluids having a higher viscosity compared to fluids for which the module shown in FIG. 10 is used.

Figure 12:
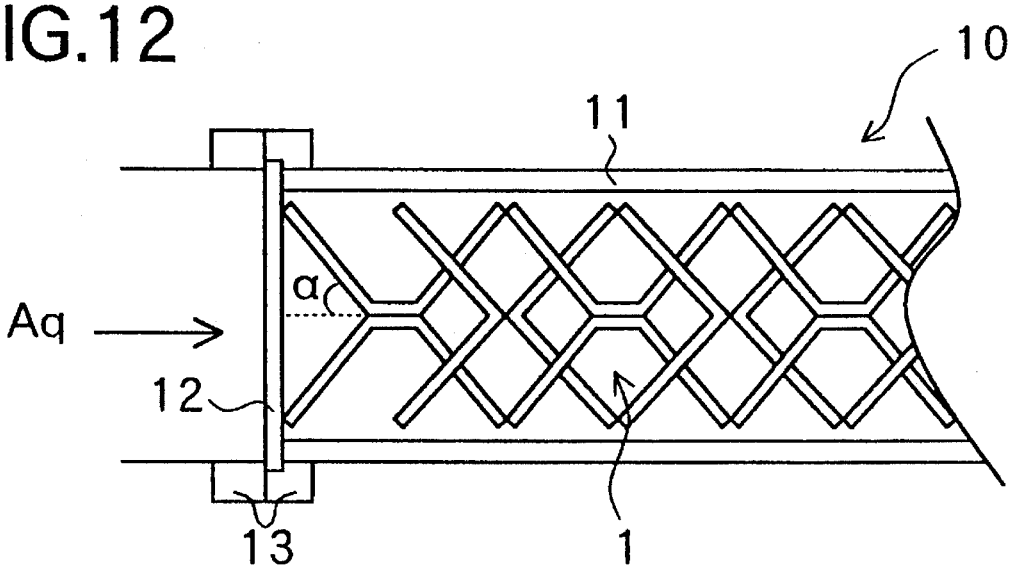

FIG. 12 shows another embodiment of the mixing apparatus in which mixing modules are combined with second mixing parts which are explained with reference to FIGS. 6–9. The mixing apparatus can reduce the pressure loss much more compared to the mixing apparatus shown in FIG. 6.

Figure 13:
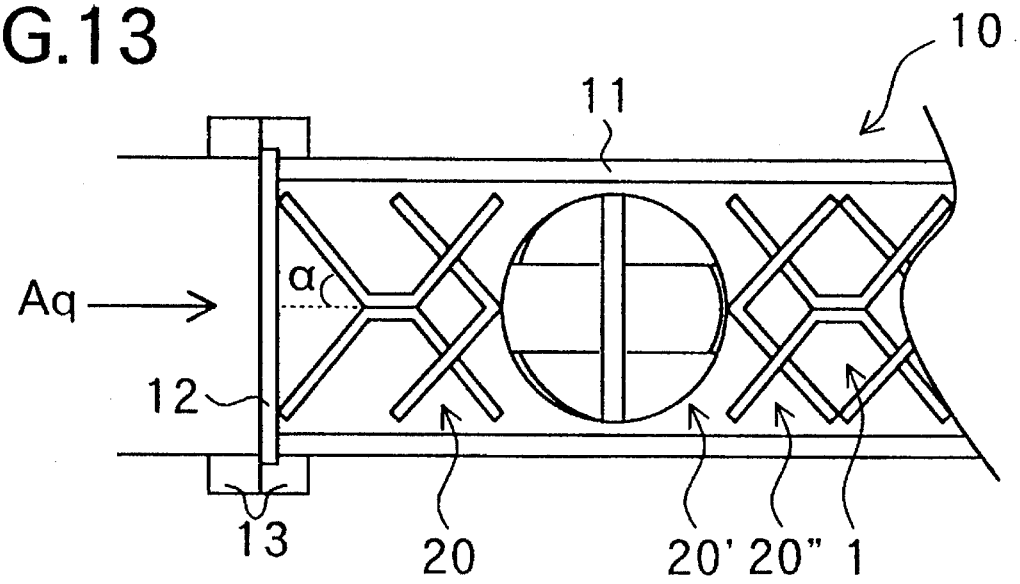

FIG. 13 shows another embodiment in which a plurality of modules 20, 20', 20", etc., are joined to each other with successive positional shifts of 90° in the peripheral direction. With this structure, the pressure loss can be reduced much more compared to the mixing apparatus shown in FIG. 5.

Figure 14:
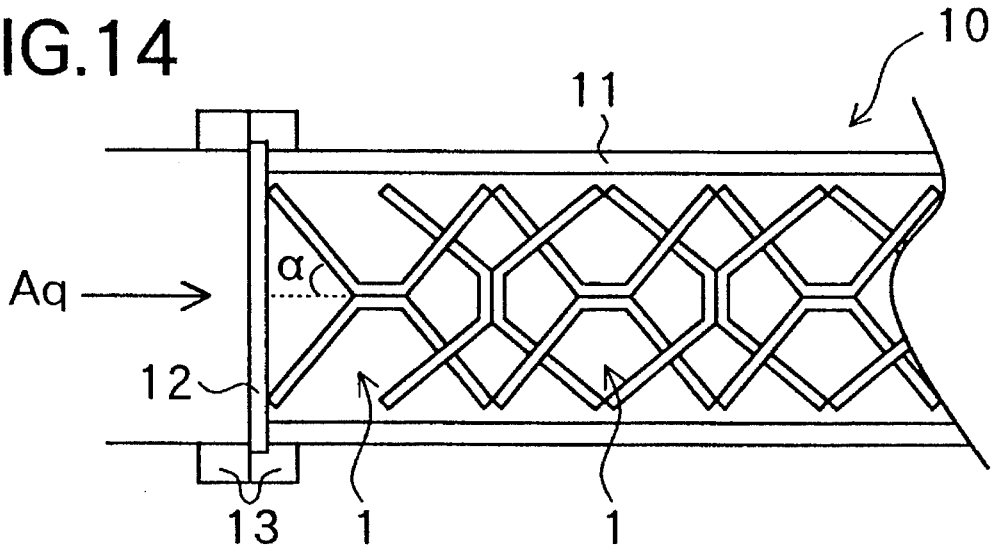
Figure 15:
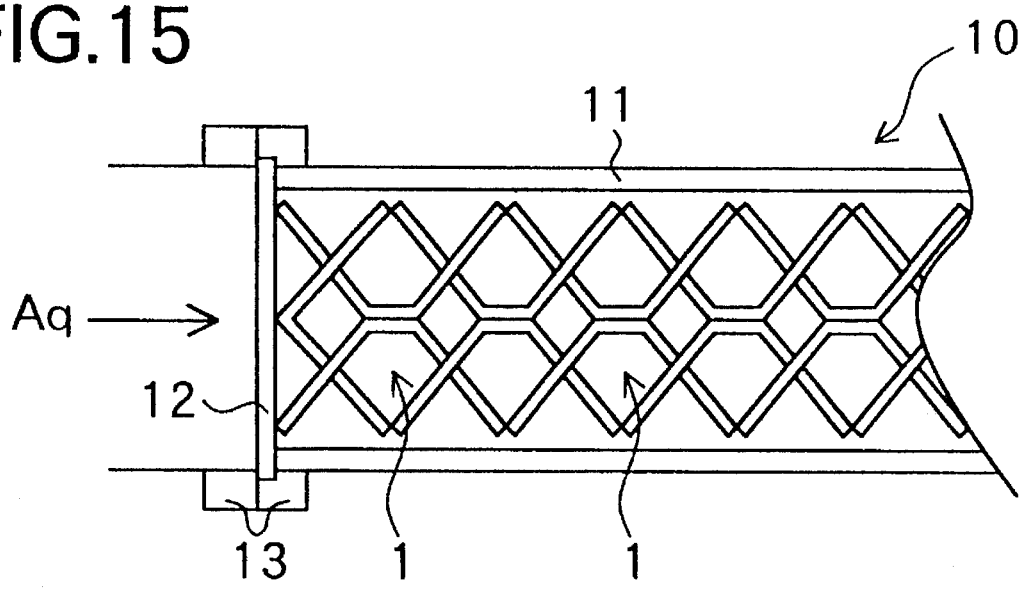

Sixth Embodiment:

FIGS. 14 and 15 show mixing apparatuses which are formed by the module 1 of the first embodiment only.

Figure 16:
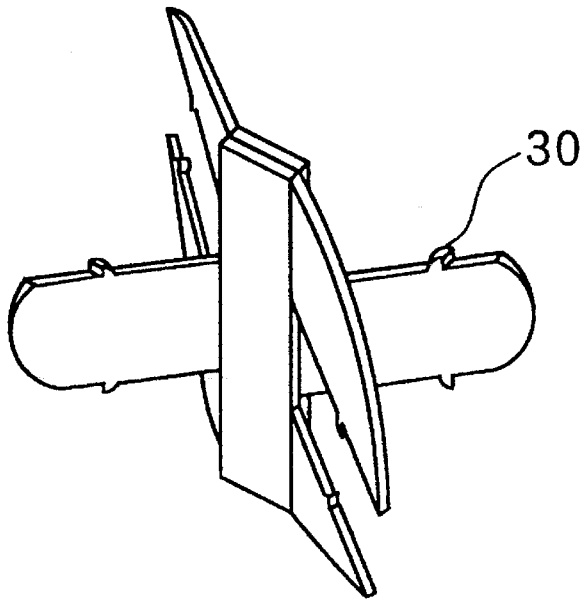
FIG. 16 is a perspective view showing still another embodiment of the static mixing module.

Seventh Embodiment:

FIG. 16 shows another example of the mixing module 1. The mixing module 1 according to the present embodiment has wing portions each of which is provided with protrusions 30 at the middle portion in the longitudinal direction. By providing the protrusions 30, the positioning of the mixing parts can be effectively carried out when the mixing parts are assembled. Needless to say, the shape of the protrusions 30 is not limited to the shape shown in FIG. 16. Instead of the protrusion 30, a linear bridge section may be formed between two adjacent wing portions.

Eighth Embodiment:

The present embodiment relates to a static mixing module which is attached to a pipe, a reactor or the like which have a large diameter, and a large mixing apparatus utilizing the static mixing module.

Figure 17:
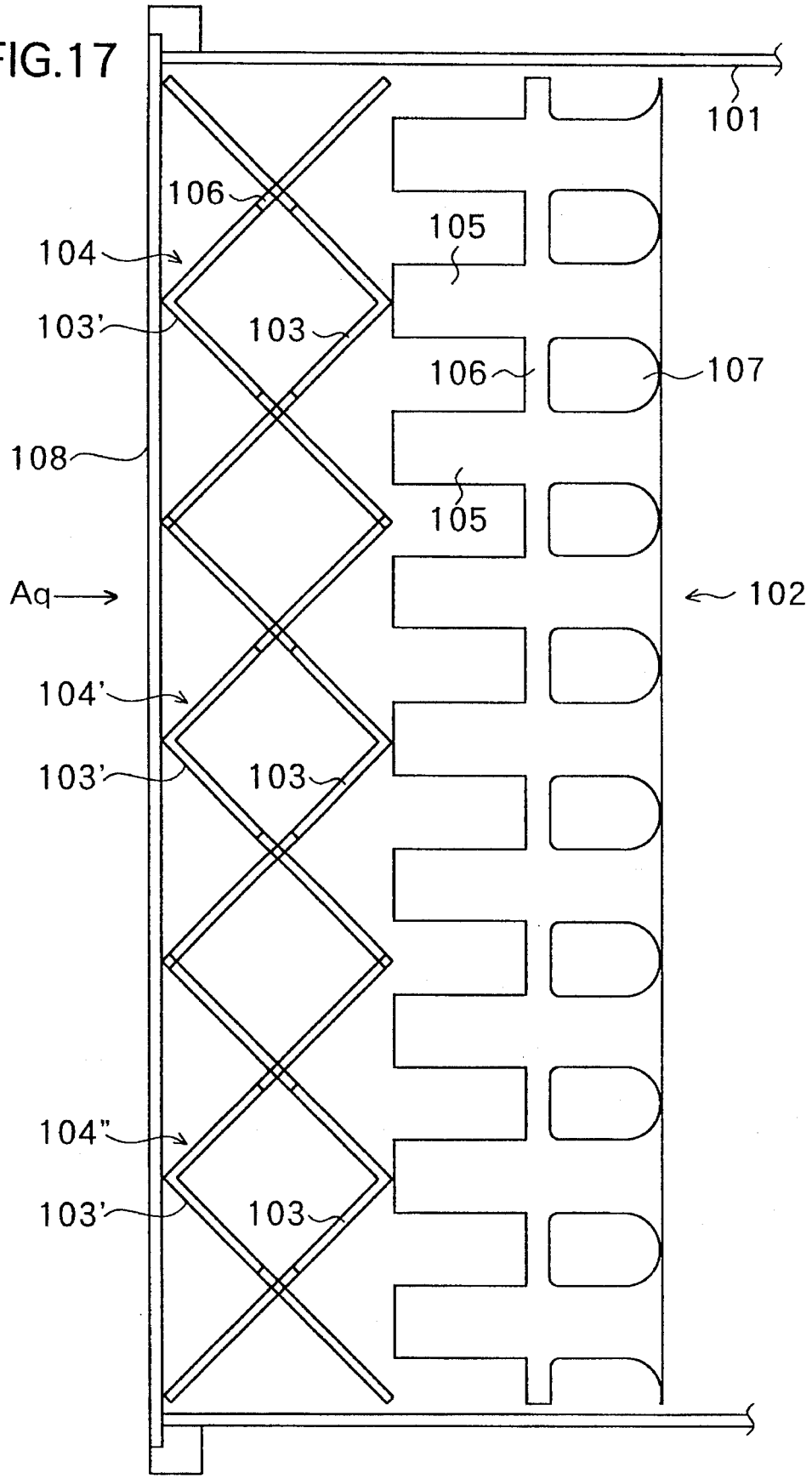
FIGS. 17 and 18 are side sectional views showing embodiments of mixing apparatus for larger pipes.

FIG. 17 is a side sectional view of a major portion of the large mixing apparatus.

In FIG. 17, numeral 101 denotes a pipe having a diameter of 300–3000 mm, and numeral 102 denotes a module placed in the pipe 101.

Each of the mixing modules 102 is formed by combining the second mixing parts which are manufactured in accordance with the manufacturing method shown in FIGS. 8 and 9. In detail, a pair of second mixing parts 103, 103' are combined in an opposed manner to obtain a subassembly 104. In this embodiment, three subassemblies 104, 104' and 104" are formed. These three subassemblies 104, 104' and 104" are lined in a diametrical direction (the upper and lower direction in FIG. 17) and are assembled to complete a module 102 for a single stage.

Although a single module 102 may be placed to form a single module stage, two or more modules 102 may be successively installed to form two or more module stages, as shown in FIG. 17. When a plurality of stages are formed by the module 102, it is preferred that the modules 102 be disposed with an angular positional shift of 90° between two adjacent modules 102. It is preferred that the module 102 in each stage be welded to an adjacent module at several points.

The second parts used in the present embodiment is provided with wing portions 105, and linear support portions 106 formed between adjacent wing portions 105. The support portions 106 are used for positioning and for increasing the strength. Numeral 107 denotes cut-out portions. Numeral 108 denotes a mounting member for fixing the module 102 to the pipe 101.

When two or more kinds of fluids Aq enter the large pipe 101, the fluids Aq are mixed and agitated by the modules 102. The modules 102 according to the present embodiment can be used for providing mixing/agitation operation and for providing contact between a gas and a liquid in a large reactor. The pipe or reactor has a circular cross section or rectangular cross section.

Although the second mixing parts 103, 103' according to the present embodiment may be manufactured by the method shown in FIGS. 8 and 9, the method of manufacturing the second mixing parts 103, 103' is not limited thereto. For example, a single plate is divided into three blocks, from which three types of subassemblies 104, 104' and 104" are formed.

The number of the wing portions of each module can be odd or even. Also, the wing portions are not required to have the same width.

Although L-shaped second mixing parts are used in the above-described embodiment, the first mixing parts shown in FIGS. 1 and 2 may be used.

Also, the bending angle of the L-shaped second mixing parts is not limited to the angle shown in the drawing.

Figure 18:
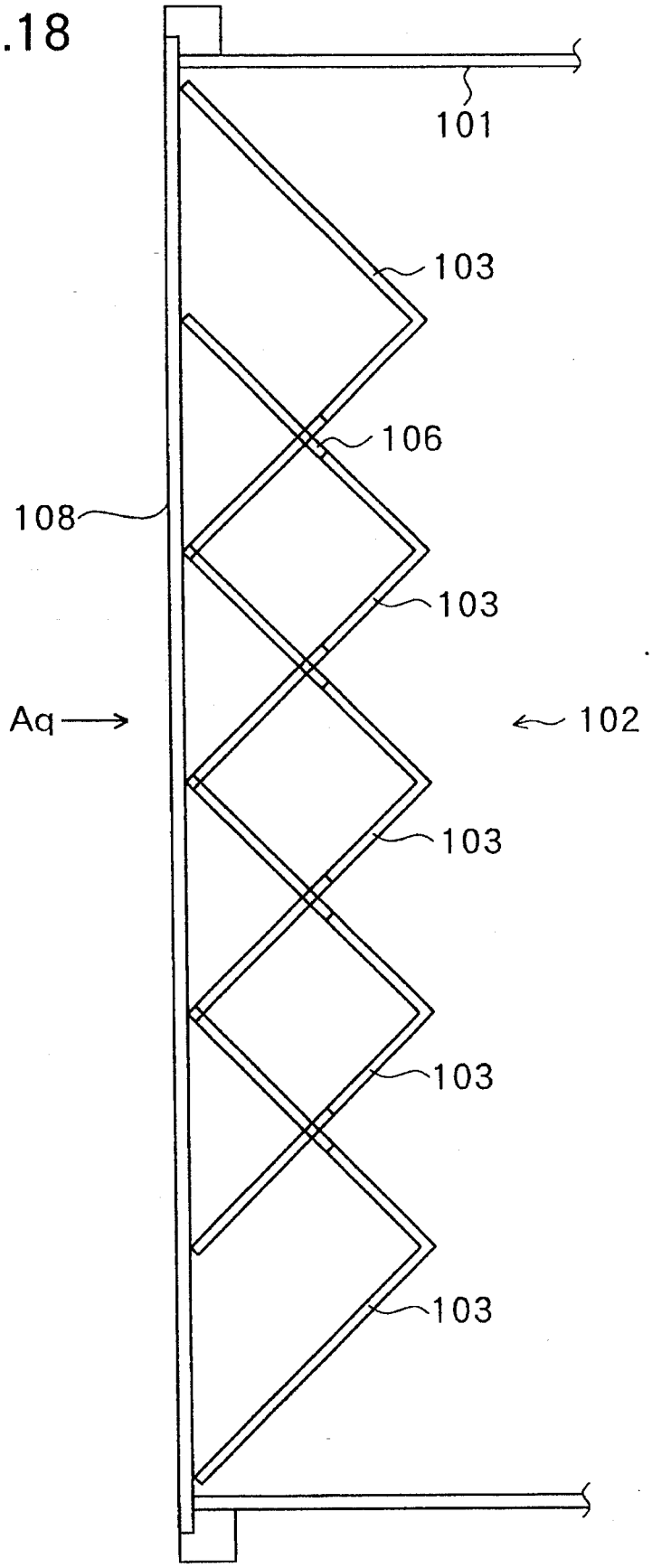
Figure 19:
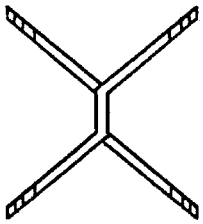
FIG.19 PRIOR ART
FIG. 19 through FIG. 23B are explanatory charts for conventional products.
Figure 20:
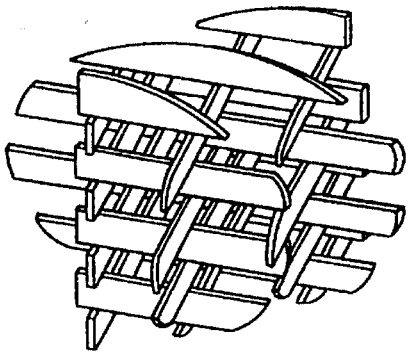
FIG.20 PRIOR ART
Figure 21A:
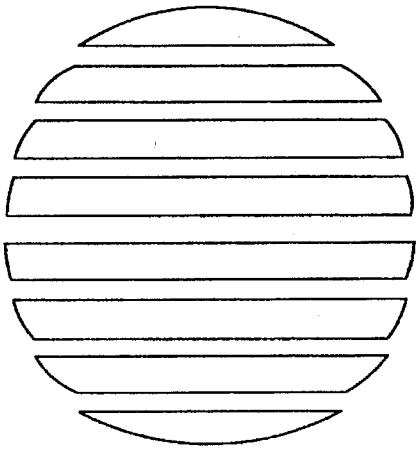
FIG.21A PRIOR ART
Figure 21B:
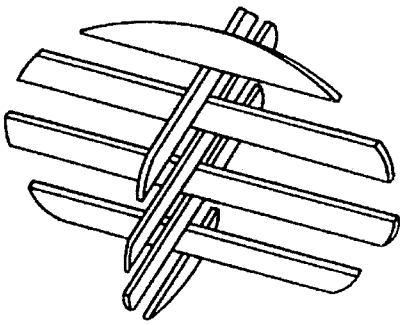
FIG.21B PRIOR ART
Figure 22A:
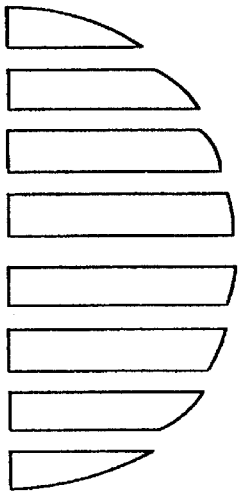
FIG.22A PRIOR ART
Figure 22B:
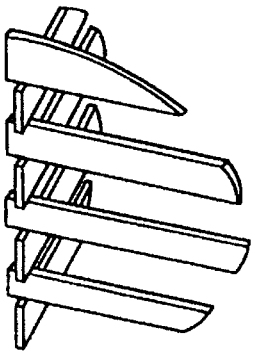
FIG.22B PRIOR ART
Figure 23A:
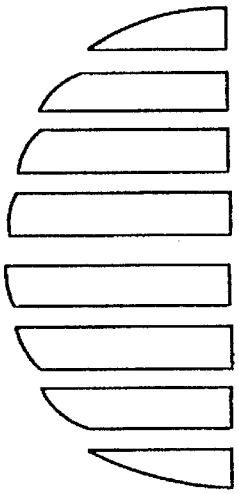
FIG.23A PRIOR ART
Figure 23B:
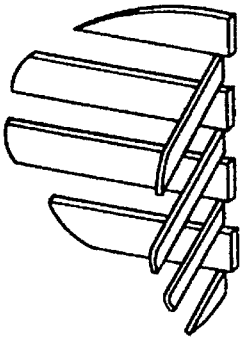
FIG.23B PRIOR ART

Moreover, the module 102 may be modified as shown in FIG. 18. In the module 102 shown in FIG. 18, a plurality of second mixing parts 103 are lined in a diametrical direction (the upper and lower direction in FIG. 18) and are combined such that the wing portions 105 of each mixing part 103 are directed in the same direction.

What is claimed is:

1. A static mixing module comprising a pair of first mixing parts each having a central strip portion, wing portions and cut-out portions, wherein each of said first mixing parts has a configuration such that said wing portions have a predetermined width and perpendicularly extend from a pair of bending lines each formed between said central strip portion and said wing portions, that said wing portions and said cut-out portions are formed on both sides of said central strip portion in a staggered manner, and that said wing portions are all bent in the same direction by a predetermined angle with respect to a front surface of said central strip portion, and wherein said pair of first mixing parts are assembled and fixed to each other at their back surfaces, serving as joint surfaces, of said central strip portions.

2. The static mixing module of claim 1 which is fixed to a pipe via a fixing member such that the joint surfaces of said central strip portions become perpendicular to the flow direction of fluids which flow into said pipe.

3. The static mixing module of claim 1 which is fixed to a pipe via a fixing member such that the joint surfaces of said central strip portions become parallel to the flow direction of fluids which flow into said pipe.

4. The static mixing module of claim 1 further comprising a second mixing part comprising wing portions which have a predetermined width and extend outwardly and perpendicularly from a center line so that cut-out portions each reaching said center line are formed, said wing portions and said cut-out portions being formed on both sides of said center line in a staggered manner, and said wing portions are bent at said center line.

5. The static mixing module of claim 4 comprising two or more static mixing module assemblies in a pipe, wherein each of said static mixing module assemblies comprises at least one said static mixing module and at least one said second mixing part, wherein said at least one static mixing module is disposed such that the joint surfaces of said central strip portions become perpendicular to the flow direction of fluids which flow into said pipe, said at least one second mixing part is placed on at least one side of said at least one static mixing module such that said wing portions of said at least one second mixing part extend in a direction opposite to the direction in which said wing portions of said at least one static mixing module located at both ends of said at least one static mixing module extend, and that said wing portions of said at least one second mixing part are inserted into opposing said cut-out portions, and wherein at least one end of an outermost one of said two or more static mixing module assemblies is fixed to said pipe via a fixing member.

6. The static mixing module of claim 4 comprising two or more static mixing module assemblies in a pipe, wherein each of said static mixing module assemblies comprises at least one said static mixing module and at least one said second mixing part, wherein said at least one static mixing module is disposed such that the joint surfaces of said central strip portions become parallel to the flow direction of fluids which flow into said pipe, said at least one second mixing part is placed on at least one side of said at least one static mixing module such that said wing portions of said at least one second mixing part extend in a direction opposite to the direction in which said wing portions of said at least one static mixing module located at both ends of said at least one static mixing module extend, and that said wing portions of said at least one second mixing part are inserted into opposing said cut-out portions, and wherein at least one end of an outermost one of said two or more static mixing module assemblies is fixed to said pipe via a fixing member.

7. The static mixing module of claim 4 comprising two or more static mixing module assemblies in a pipe, wherein each of said static mixing module assemblies comprises at least one said static mixing module and at least one said second mixing part, said at least one static mixing module is disposed such that the joint surfaces of said central strip portions become parallel to the flow direction of fluids which flow into said pipe, said at least one second mixing part is placed on at least one side of said at least one static mixing module such that said wing portions of said at least one second mixing part extend in a direction opposite to the direction in which said wing portions of said at least one static mixing module located at both ends of said at least one static mixing module extend, and that said wing portions of said at least one second mixing part are inserted into opposing said cut-out portions, and wherein each of said two or more static mixing module assemblies is joined to an adjacent one of said two or more static mixing module assemblies with a positional shift of 45°–90° in the circumferential direction while maintaining the state that the joint surfaces of said central strip portions of each of said two or more static mixing module assemblies become parallel to the flow direction of fluids which flow into said pipe, and at least one end of an outermost one of said two or more static mixing module assemblies is fixed to said pipe via a fixing member.

8. The static mixing module of claim 4 in a pipe having a large diameter comprising a plurality of said second mixing parts, wherein said first and second mixing parts are lined in a diametrical direction of said pipe and are assembled such that each pair of one of each of said first and second mixing parts is assembled in a manner where said pair of mixing parts face each other.

9. The static mixing module of claim 4 in a pipe having a large diameter comprising a plurality of said second mixing parts, wherein said first and second mixing parts are lined in a diametrical direction of said pipe and are assembled such that each pair of one of each of said first and second mixing parts is assembled in a manner where said wing portions of said pair of mixing parts are directed to the same direction.

10. The static mixing module of claim 1 comprising two or more static mixing module assemblies in a pipe, wherein each of said static mixing module assemblies comprises at least one said static mixing module, wherein said at least one static mixing module is disposed in said pipe such that the joint surfaces of said central strip portions become perpendicular to the flow direction of fluids which flow into said pipe, said first mixing parts are placed on both sides of said at least one static mixing module such that said wing portions of each said first mixing part extend in a direction opposite to the direction in which said wing portions of said at least one static mixing module located at both ends of said at least one static mixing module extend, that the longitudinal direction of said central strip portions of said at least one static mixing module coincides with the longitudinal direction of said central strip portions of said first mixing parts, and that said wing portions of said first mixing parts are inserted into opposing said cut-out portions, and wherein each of said two or more static mixing module assemblies is joined to and adjacent one of said two or more static mixing module assemblies with a positional shift of 45°–90° in the circumferential direction while maintaining the state that the joint surfaces of said central strip portions of each of said two or more mixing module assemblies become perpendicular to the flow direction of fluids which flow into said pipe, and at least one end of an outermost one of said two or more static mixing module assemblies is fixed to said pipe via a fixing member.

11. A static mixing module comprising a second mixing part with plural wing portions which have a predetermined width and extend outwardly and perpendicularly from a center line with cut-out portions between said wing portions which reach said center line, said cut-out portions each having an arcuate shape at said center line so that an apex of said arcuate shape extends beyond said center line, said wing portions and said cut-out portions being formed on both sides of said center line in a staggered manner, and said wing portions are bent at said center line.

12. The static mixing module of claim 11 in a pipe having a large diameter further comprising a plurality of said second mixing parts, wherein said second mixing parts are lined in a diametrical direction of said pipe and are assembled such that each pair of said second mixing parts is assembled in a manner where said pair of second mixing parts face each other.

13. The static mixing module of claim 11 in a pipe having a large diameter comprising a plurality of said second mixing parts, wherein said second mixing parts are lined in a diametrical direction of said pipe and are assembled such that each pair of said second mixing parts is assembled in a manner where said wing portions of each of said second mixing parts are directed to the same direction.

* * * * *